US009803605B2

(12) United States Patent
Serra et al.

(10) Patent No.: US 9,803,605 B2
(45) Date of Patent: Oct. 31, 2017

(54) FLUID INJECTION ASSEMBLY

(71) Applicant: Continental Automotive GmbH, Hannover (DE)

(72) Inventors: Giandomenico Serra, San Giuliano Terme (IT); Marco Pasquali, Leghorn (IT); Gisella Di Domizio, San Giuliano Terme (IT)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 177 days.

(21) Appl. No.: 14/508,121

(22) Filed: Oct. 7, 2014

(65) Prior Publication Data

US 2015/0101573 A1 Apr. 16, 2015

(30) Foreign Application Priority Data

Oct. 14, 2013 (EP) ..... 13188534

(51) Int. Cl.
*F02M 61/14* (2006.01)
*F02M 55/02* (2006.01)
(Continued)

(52) U.S. Cl.
CPC ..... *F02M 61/14* (2013.01); *F02M 55/025* (2013.01); *F02M 61/166* (2013.01);
(Continued)

(58) Field of Classification Search
CPC ..... F02M 2200/803; F02M 2200/8023; F02M 2200/85; F02M 2200/853; F02M 2200/855; F02M 2200/86; F02M 61/14
(Continued)

(56) References Cited

U.S. PATENT DOCUMENTS 4,246,877 A * 1/1981 Kennedy ..... F02M 61/14 123/470
8,171,917 B2 * 5/2012 Di Domizio ..... F02M 55/02 123/456

FOREIGN PATENT DOCUMENTS

EP 2241746 A1 10/2010 ..... F02M 55/00
EP 2375052 A1 10/2011 ..... F02M 55/02
(Continued)

OTHER PUBLICATIONS

European Search Report, Application No. 13188534.5, 5 pages, dated Feb. 20, 2014.
(Continued)

*Primary Examiner* — Jacob Amick
*Assistant Examiner* — Michael A Kessler
(74) *Attorney, Agent, or Firm* — Slayden Grubert Beard PLLC

(57) ABSTRACT

A fuel injector assembly with a fuel injector and a coupling device is disclosed. The coupling device includes a fuel injector cup, a plate element, one or more screws and a wing clip. The plate element includes at least one through-hole for fixedly coupling the fuel injector cup with the plate element by the screw or screws respectively, so that the fuel injector cup, the plate element and the screw(s) are positionally fixed with respect to each other. The wing clip is arranged at least partly around the fuel injector and extends outward in a radial direction such that the screw or screws, respectively, are operable to block a movement of the fuel injector relative to the plate element in a first direction of the central longitudinal axis by mechanical interaction with the wing clip.

16 Claims, 5 Drawing Sheets

(51) Int. Cl.
*F02M 63/02* (2006.01)
*F02M 61/16* (2006.01)

(52) U.S. Cl.
CPC ... *F02M 63/0275* (2013.01); *F02M 2200/803* (2013.01); *F02M 2200/8023* (2013.01); *F02M 2200/853* (2013.01); *F02M 2200/855* (2013.01); *F02M 2200/856* (2013.01)

(58) Field of Classification Search
USPC ..... 123/470; 411/516, 520, 522, 539, 411/172–175
See application file for complete search history.

(56) References Cited

FOREIGN PATENT DOCUMENTS

| | | | | |
|---|---|---|---|---|
| WO | 2004/025113 A1 | 3/2004 | ..... | F02M 55/00 |
| WO | 2013/034450 A1 | 3/2013 | ..... | F02M 61/14 |

OTHER PUBLICATIONS

Chinese Office Action, Application No. 201410540314.0, 12 pages, Jun. 29, 2017.

* cited by examiner

FLUID INJECTION ASSEMBLY

CROSS-REFERENCE TO RELATED APPLICATIONS

This application claims priority to EP Patent Application No. 13188534 filed Oct. 14, 2013. The contents of which are incorporated herein by reference in their entirety.

TECHNICAL FIELD

The invention relates to a fuel injector assembly with a fuel injector and a coupling device for hydraulically and mechanically coupling the fuel injector to a fuel rail of a combustion engine.

BACKGROUND

Coupling devices for hydraulically and mechanically coupling a fuel injector to a fuel rail are in widespread use, in particular for internal combustion engines. Fuel can be supplied to an internal combustion engine by the fuel rail assembly through the fuel injector. The fuel injectors can be coupled to the fuel injector cups in different manners.

In order to keep pressure fluctuations during operation of the internal combustion engine at a very low level, internal combustion engines are supplied with a fuel accumulator to which the fuel injectors are connected and which has a relatively large volume. Such a fuel accumulator is often referred to as a common rail.

Fuel rails can comprise a hollow body with recesses in the form of fuel injector cups. The fuel injectors are attached to the fuel injector cups. The connection of the fuel injectors to the fuel injector cups that supply the fuel from a fuel tank via a low or high-pressure fuel pump needs to be very precise to get a correct injection angle and a sealing of the fuel.

SUMMARY

One embodiment provides a fuel injector assembly with a fuel injector and a coupling device for hydraulically and mechanically coupling the fuel injector to a fuel rail for a combustion engine, the fuel injector having a central longitudinal axis and the coupling device comprising a fuel injector cup, a plate element, one or more screws, and a wing clip, wherein the fuel injector cup is configured to be hydraulically coupled to the fuel rail and in which a fuel inlet portion of the fuel injector is received, wherein the plate element comprises a central opening through which the fuel injector extends and at least one through-hole for fixedly coupling the fuel injector cup with the plate element by the screw or screws respectively, so that the fuel injector cup, the plate element and the screw(s) are positionally fix with respect to each other, and wherein the wing clip is arranged at least partly around the fuel injector and extends outward in a radial direction such that the screw or screws, respectively, are operable to block a movement of the fuel injector relative to the plate element in a first direction of the central longitudinal axis by means of mechanical interaction with the wing clip.

In a further embodiment, the coupling device further comprises a snap ring which is operable to interact mechanically with the plate element and the fuel injector to retain the fuel injector in the fuel injector cup by blocking a movement of the fuel injector relative to the plate element in a second direction of the central longitudinal axis, which is opposite to the first direction of the central longitudinal axis.

In a further embodiment, the central opening of the plate element comprises a step and the snap ring bears on the step.

In a further embodiment, the fuel injector comprises a shoulder extending in a radial direction and the wing clip is arranged axially between the shoulder and the plate element such that the screw or screws, respectively, are in contact with the wing clip, and in particular are operable to press the wing clip against the shoulder.

In a further embodiment, the wing clip has a spring characteristic.

In a further embodiment, the wing clip comprises a spring steel.

In a further embodiment, the wing clip comprises one or more recesses for keeping the screw or screws, respectively, in a given position.

In a further embodiment, the at least one screw comprises a bolt length such that a given bending of the wing clip is reached.

BRIEF DESCRIPTION OF THE DRAWINGS

Example embodiments of the invention are explained in detail below with reference to the drawings, in which.

Elements of the same design and function that occur in different illustrations are identified by the same reference character.

DETAILED DESCRIPTION

Figure 1:
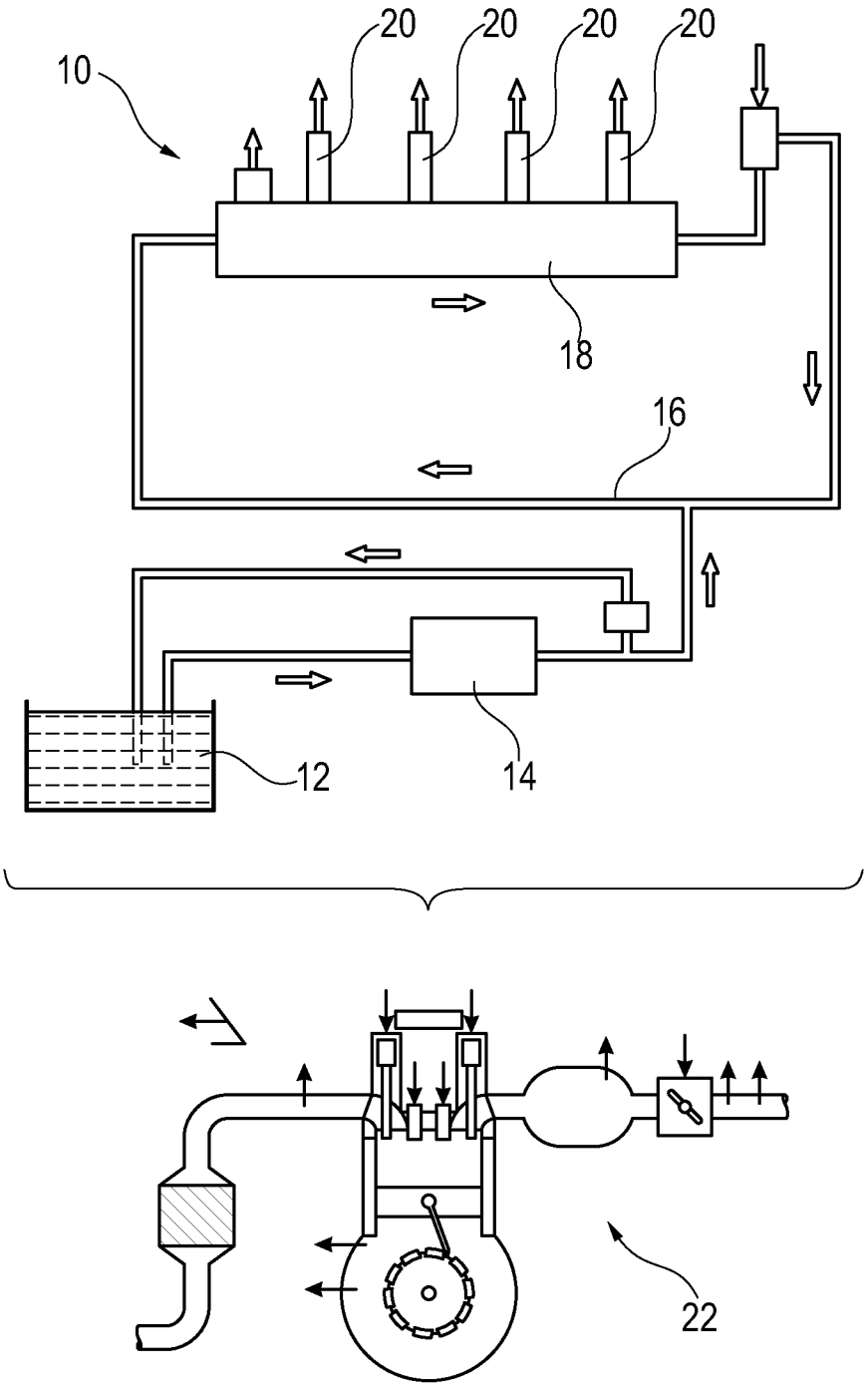
FIG. 1 shows an internal combustion engine in a schematic view.

Embodiments of the invention specify a fuel injector assembly with a fuel injector and a coupling device for hydraulically and mechanically coupling the fuel injector to a fuel rail, wherein the fuel injector assembly can be manufactured in a simple way and allows for a reliable and precise connection between the fuel injector and the fuel injector cup without the fuel injector resting on the cylinder head.

A fuel injector assembly with a fuel injector and a coupling device for hydraulically and mechanically coupling the fuel injector to a fuel rail for a combustion engine is specified. The fuel injector has a central longitudinal axis. The coupling device comprises a fuel injector cup, a plate element, one or more screws and a wing clip.

The fuel injector cup is configured to be hydraulically coupled to the fuel rail. In one embodiment, the fuel injector cup is hydraulically mechanically coupled to the fuel rail. By means of the mechanical coupling, it is in particular positionally fix with respect to the fuel rail. A fuel inlet portion of the fuel injector is received in the fuel injector cup. In particular, the fuel inlet portion is shifted into the fuel injector cup so that the latter covers and laterally surrounds the fuel inlet portion. The fuel injector may expediently be coupled hydraulically to the fuel rail via the fuel injector cup.

The plate element has a central opening through which the fuel injector extends. In particular, the fuel injector and the plate element are shaped such that the fuel inlet portion of the fuel injector can be shifted through the central opening of the plate element for assembling the fuel injector assembly. Further, the plate element comprises at least one through-hole for fixedly coupling the fuel injector cup with the plate element by the screw or the screws, respectively. By means of the fixed coupling of the fuel injector cup with the plate element by means of the screw(s), the plate element, the fuel injector cup and the screw(s) are positionally fix with respect to each other. In particular, the through-hole(s) is/are threaded and a threaded connection is established between the screw(s) and the plate element. A form-fit coupling may be established between the plate element and the fuel injector cup and between a respective head of each screw and the fuel injector cup.

Furthermore, the wing clip is arranged at least partly around the fuel injector and extends outward in a radial direction such that the screw or screws, respectively, are operable to block a movement of the fuel injector relative to the plate element in a first direction of the central longitudinal axis by means of mechanical interaction with the wing clip.

In the assembled state of the fuel injector assembly—for example when the fuel injector assembly is mounted to the combustion engine—the screw(s) is/are in contact with the wing clip to prevent movement of the fuel injector relative to the plate element in the first direction. In particular, the screw or each of the screws, respectively, extends axially through the corresponding through-hole and preferably projects axially beyond the plate element towards the wing clip. An axial gap between the plate element and the wing clip may be established in this way.

Axial displacement of the fuel injector relative to the fuel injector cup in the first direction corresponds in particular to a displacement of the fuel injector towards the fuel injector cup so that the fuel inlet portion is in particular shifted further into the fuel injector cup.

A wing clip is in particular a clip having a generally ring-segment shaped portion for engaging with the fuel injector and one or more plate-shaped portions extending radially outward from the ring-segment shaped portion. Such radially outward extending plate-shaped portions can be also denoted as wings. A surface normal of a main surface of each plate shaped portion may be parallel or inclined with respect to the longitudinal axis but preferably not perpendicular to the longitudinal axis.

This has the advantage that a movement of the fuel injector relative to the fuel injector cup in the first direction of the central longitudinal axis can be prevented. The wing clip may easily be mounted and disassembled. Furthermore, the wing clip does not exert an additional force on the injector during the assembling process. As the wing clip can be arranged outside the fuel injector cup, the wing clip can be assembled and disassembled without disassembling the fuel injector cup from the injector.

By means of the fuel injector assembly according to the present disclosure, a minimum length of the fuel injector which projects out of the fuel injector cup can easily be set. In this way, a particularly precise positioning of a fuel outlet portion of the fuel injector is achievable. The risk that the fuel injector is shifted into the fuel injector cup too far—for example during assembling of the fuel injector assembly or due to external forces acting on the fuel injector during operation, e.g. effected by the combustion process—is particularly small.

The screw coupling between the plate element and the fuel injector cup has the advantage that a simple construction of the coupling device is possible, which allows for carrying out a fast and secure coupling of the fuel injector in the fuel injector cup. Furthermore, a defined positioning of the fuel injector relative to the fuel injector cup in axial and circumferential direction is possible.

In one embodiment two screws are used for the coupling. The wing clip has in particular two wings, each being assigned to one of the screws.

In one embodiment, and the coupling device further comprises a snap ring which is operable to interact mechanically with the plate element and the fuel injector to retain the fuel injector in the fuel injector cup by blocking a movement of the fuel injector relative to the plate element in a second direction of the central longitudinal axis, which is opposite to the first direction of the central longitudinal axis.

With the wing clip for blocking movement of the fuel injector relative to the plate element—and thus the fuel injector cup—in the first axial direction and the spring clip for blocking movement of the fuel injector relative to the plate element—and thus the fuel injector cup—in the second axial direction, a movement of the fuel injector relative to the fuel injector cup in both directions of the central longitudinal axis can be prevented. In this way the position of the fuel injector is preferably fixed with respect to the fuel injector cup. The fuel injector is installable in an intake manifold or in a cylinder head of the internal combustion engine without direct mechanical contact between the fuel injector and the intake manifold or the cylinder head, respectively. This suspended fuel injector installation may contribute advantageously to noise reduction.

The fuel injection assembly is configured such that during the mounting of the plate element and the snap ring there is enough space to allow for a limited movement of the injector relative to the plate element and the snap ring.

In one embodiment, the central opening of the plate element comprises a step and the snap ring bears on the step for blocking movement of the fuel injector relative to the plate element in the second direction. By means of the step, two portions of the central opening may be defined: a first portion adjacent to the fuel injector cup and a second portion further away from the fuel injector cup, the second portion having a smaller cross-section than the first portion. The fuel injector may have a collar subsequent to the step and the snap ring in axial direction towards the fuel injector cup. The snap ring may bear on the collar for blocking movement of the fuel injector relative to the plate element in the second direction.

In a further embodiment, the fuel injector comprises a shoulder extending in the radial direction, and the wing clip is arranged axially between the shoulder and the plate element such that the screw or screws, respectively, are in contact with the wing clip. In particular, the screw(s) is/are operable to press the wing clip against the shoulder. This has the advantage that the shoulder offers a secure supporting surface for the wing clip. Consequently, the shoulder allows for a defined positioning of the fuel injector relative to the fuel injector cup in the axial direction.

In a further embodiment, the wing clip has a spring characteristic. In other words, the wing clip is elastically deformable and elastically deformed by the screw(s) so that it biases the fuel injector in the second direction. In this way, the fuel injector may be pressed against the snap ring and the snap ring may be in turn pressed against the plate element. Advantageously, this allows for reliably avoiding the movement into the first direction. With advantage, vibrations of the fuel injector relative to the plate element and to the fuel injector cup which is positionally fix with respect to the plate element may be reduced or prevented in this way.

In a further embodiment, the wing clip comprises a spring steel or consists thereof. Preferably, the wing clip comprises a spring stainless steel or consists thereof. This allows for easy and cost-effective manufacture of the wing clip.

In a further embodiment, the wing clip comprises one recess or more recesses for keeping the screw or screws, respectively, in a given position. For example, the recess(es) may be operable to guide the screw(s) to a given lateral position. The recesses may be manufactured in an easy and cost-effective manner by means of a drawn process.

In a further embodiment the at least one screw comprises a bolt length such that, in the assembled state of the fuel injector assembly, a given bending of the wing clip is reached. Advantageously, this allows for reliably avoiding the movement into the first direction.

A fuel feed device 10 is assigned to an internal combustion engine 22 (FIG. 1), which can be a diesel engine or a gasoline engine. It includes a fuel tank 12 that is connected via a first fuel line to a fuel pump 14. The output of the fuel pump 14 is connected to a fuel inlet 16 of a fuel rail 18. Fuel injectors 20 are connected to the fuel rail 18, and the fuel is fed to the fuel injectors 20 via the fuel rail 18.

Figure 2:
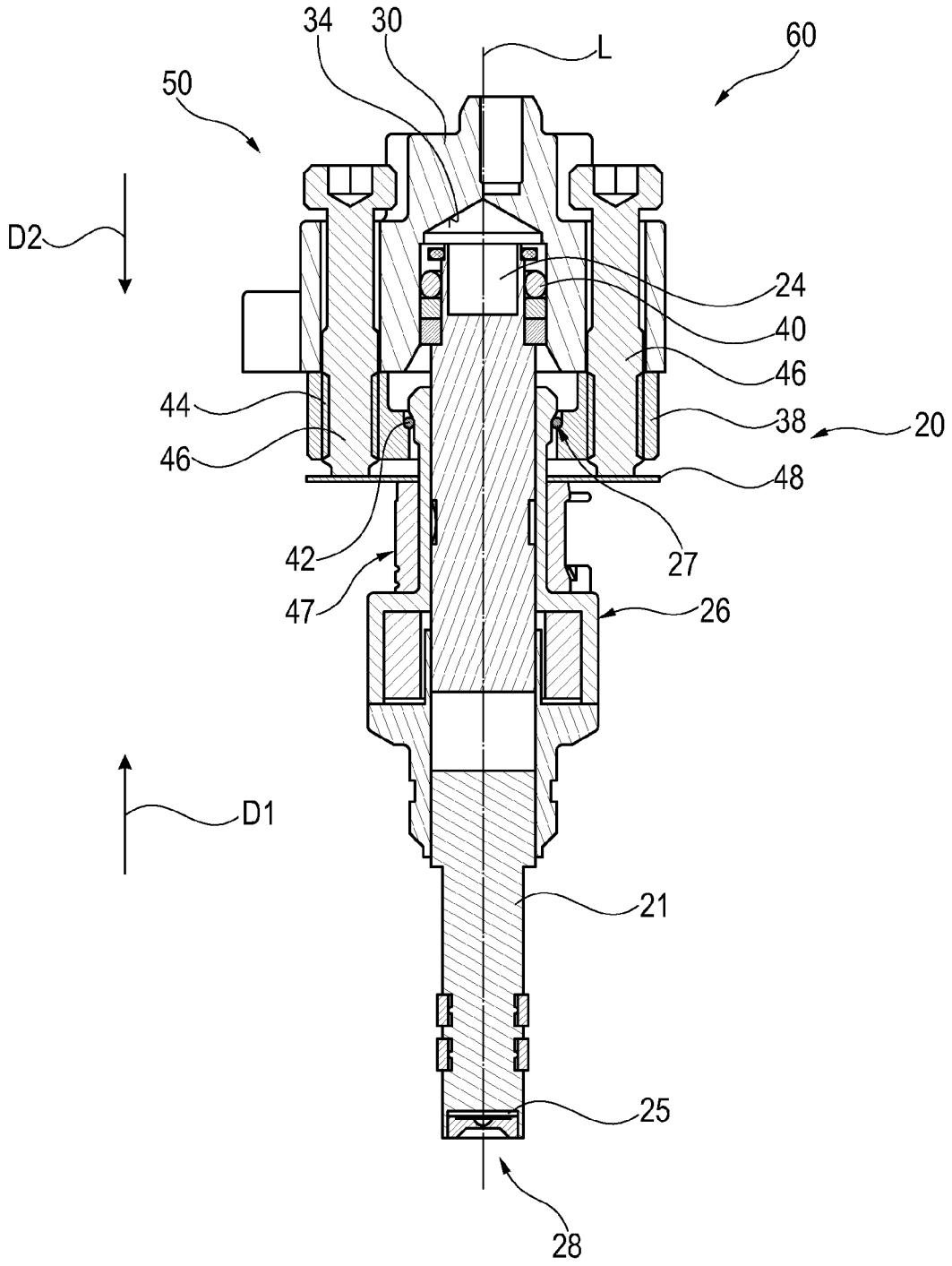
FIG. 2 shows a longitudinal section through a fuel injector assembly with a first example of a coupling device before screw assembly.

FIG. 2 shows the fuel injector 20 with a central longitudinal axis L. The view of FIG. 2 is simplified in that the constituent parts of the fuel injector 20—in particular the valve assembly and the fluid path through the fuel injector 20—are not shown in detail. The fuel injector 20 has a hollow fuel injector body 21 and is suitable for injecting fuel into a combustion chamber of the internal combustion engine 22. The fuel injector 20 has a fuel inlet portion 24 and a fuel outlet portion 25.

Furthermore, the fuel injector 20 comprises a valve needle (not shown) arranged in a cavity (not shown) of the fuel injector body 21. On a free end of the fuel injector 20 an injection nozzle 28 is formed, which is closed or opened by an axial movement of the valve needle. In a closing position, a fuel flow through the injection nozzle 28 is prevented. In an opening position, fuel can flow through the injection nozzle 28 into the combustion chamber of the internal combustion engine 22.

Figure 3:
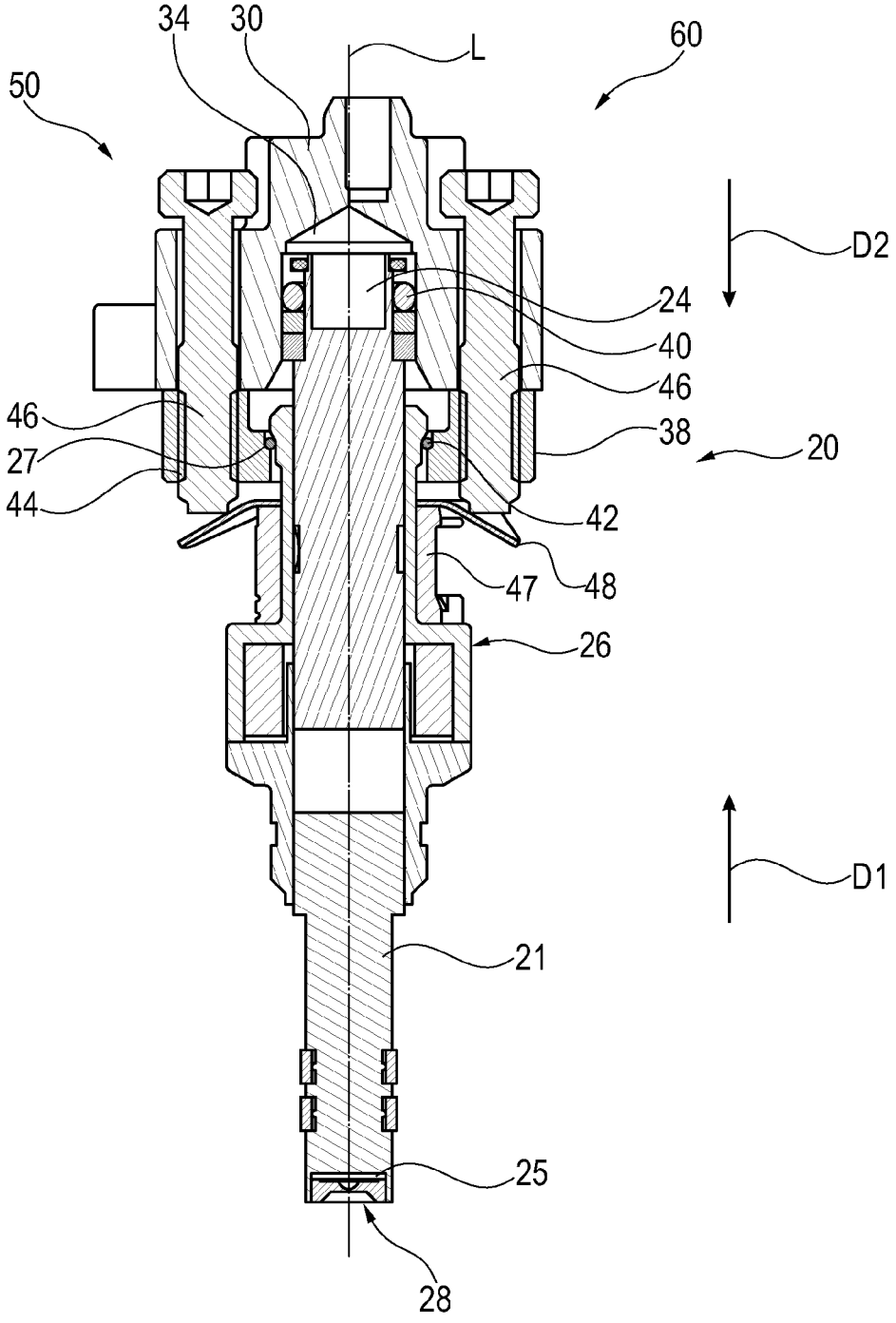
FIG. 3 shows a longitudinal section through a fuel injector assembly with the first example of a coupling device after final screw assembly.

FIGS. 2 and 3 show a fuel injector assembly 60 with the fuel injector 20 and a coupling device 50. The coupling device 50 is preferably fixedly coupled to the fuel rail 18 of the internal combustion engine 22. The fuel rail 18 may be fixed to a cylinder head of the internal combustion engine 22, for example by means of a screw connection. The fuel injector 20 is suspended from the fuel rail 18 so that there is a gap at all places between the fuel injector 20 and the cylinder head. A sealing ring around the fuel injector body 21 may bridge the gap in places, in particular for sealing the combustion chamber.

During standard operation such a suspended fuel injector is normally in a correct position. But it might happen that, in some particular situations during the life of the fuel rail 18, the fuel injector 20 is subject to force which would lead to a translational displacement towards the fuel injector cup 30, i.e. in a first direction D1 along the longitudinal axis L, for a conventional suspended fuel injector 20. Situations like these, during which this effect occurs, are first of all the assembly of the fuel rail 18 onto the cylinder head and might also occur during a working phase when a combustion chamber pressure is higher than the fuel rail pressure.

The coupling device 50 has a fuel injector cup 30. The fuel injector cup 30 comprises an inner surface 34 and is hydraulically coupled to the fuel rail 18. It is also mechanically fixed to the fuel rail 18. The fuel inlet portion 24 of the fuel injector 20 is positioned in a recess of the fuel injector cup 30, the recess being in particular defined by the inner surface 34. The fuel inlet portion 24 of the fuel injector 20 is provided with a sealing ring 40. The sealing ring 40 allows for an engagement of the fuel injector cup 30 with the fuel inlet portion 24 of the fuel injector 20. In other words, the sealing ring 40 provides a seal between the fuel inlet portion 24 of the fuel injector 20 and the inner surface 34 of the fuel injector cup 30 when the fuel inlet portion 24 is inserted into the fuel injector cup 30.

Further, the coupling device 50 comprises a plate element 38. The plate element 38 has a central opening through which the fuel injector 20 extends in longitudinal direction L.

The fuel injector cup 30 and the plate element 38 comprise through-holes 44. The fuel injector cup 30 and the plate element 38 are fixedly coupled with each other by screws 46. The through-holes 44 of the plate element 38 may be threaded for establishing a thread-connection with the screws. The through-holes of the injector cup 30 may be dimensioned such that the screws can be shifted through them until a head of the respective screw comes into form-fit engagement with the fuel injector cup 30. Each of the screws 46 is received by one of the through-holes 44 of the fuel injector cup 30. Each of the screws 46 is screwed into the plate element 38.

Furthermore, the coupling device 50 comprises a wing clip 48 being arranged at least partly around the fuel injector 20 and extending outward in a radial direction such that the screw 46 or screws 46, respectively, are, at least in a state when the fuel injector assembly 60 is mounted in the in the combustion engine 22, in contact with the wing clip 48, to prevent a movement of the fuel injector 20 relative to the plate element 38 in the first direction D1 of the central longitudinal axis L.

The wing clip 48 comprises, for example, a spring characteristic, i.e. it is elastically deformable. In particular, the wings of the wing clip 48 are elastically bendable from a configuration in which a surface normal of a main surface of each wing is parallel to the longitudinal axis L (see FIG. 2 and FIG. 5) to a configuration in which the surface normal is inclined with respect to the longitudinal axis L (see FIG. 3 and FIG. 6). For instance, the wing clip 48 comprises a spring steel, in particular a spring stainless steel.

For instance, the fuel injector 20 comprises a collar which is arranged at an outer surface of the fuel injector body 21. The coupling device 50, for instance, has a snap ring 42 which is arranged adjacent to the collar of the fuel injector 20 and in particular is in engagement with the collar. Furthermore, the central opening of the plate element 38 has a step 27 which is operable to come into in engagement with the snap ring 42. The snap ring 42 allows for a positive fitting coupling between the plate element 38 and the fuel injector 20 by means of a form-fit engagement between the collar and the snap ring 42 and between the snap ring 42 and the step 27 to block a movement of the fuel injector 20 relative to the plate element 38 in a second direction D2. Since the plate element 38 is positionally fix with respect to the fuel injector cup 30 by means of the connection via the screws 46, displacement of the fuel injector 20 relative to the fuel injector cup 30 in the second direction D2 is also blocked.

By this, a movement of the fuel injector 20 relative to the plate element 38 in a second direction D2 can be prevented, wherein the second direction D2 is opposite to the first direction D1.

For instance, the fuel injector 20 comprises a shoulder 47 which extends in a radial direction. The wing clip 48 is arranged axially between the shoulder 47 and the plate element 38 such that the screw 46 or screws 46, respectively, are, at least in a state when the fuel injector assembly 60 is mounted in the in the combustion engine 22, in contact with the wing clip 48.

In the following, the assembly and disassembly of the fuel injector 20 with the fuel injector cup 30 are described:

For assembling the fuel injector 20 with the fuel injector cup 30, the plate element 38 is shifted over the fuel injector 20 in longitudinal direction so that the fuel inlet portion 24 protrudes axially beyond the plate element 38. The snap ring 42 is shifted radially over the valve body 21 or the housing 26 of the fuel injector 20 axially between the collar and the plate element 38. In this way, a movement of the fuel injector 20 relative to the plate element 38 in the second direction D2 of the central longitudinal axis L is limited by the snap ring 42 coming into form-fit engagement with the collar and with the step 27 of the plate element 30.

Furthermore, the fuel inlet portion 24 of the fuel injector 20 is shifted into the fuel injector cup 30, for example in such a way that the fuel injector cup 30 and the plate element 38 are in engagement with each other. Now the sealing ring 40 is in sealing engagement with the inner surface 34 of the fuel injector cup 30 and the fuel inlet portion 24 of the fuel injector.

Then the wing clip 48 is arranged between the plate element 38 and the shoulder 47. Alternatively, the wing clip 48 can also be mounted on the fuel injector 20 before inserting the fuel injector 20 into the fuel injector cup 30. The wing clip may be mounted by snapping the wing clip onto an injector housing 26.

Then, the screws 46 are screwed into the plate element 38 until the heads of the screws and the plate element 38 each are in form-fit engagement with the fuel injector cup 30. For instance, the at least one screw 46 comprises a bolt length such that, in the mounted state of the fuel injector assembly 60 shown in FIG. 3, a given bending of the wing clip 48 is reached.

By this, a movement of the fuel injector 20 relative to the fuel injector cup 30 in the first direction D1 is prevented. After the assembling process, fuel can flow through the fuel injector cup 30 into the fuel inlet portion 24 of the fuel injector 20 without a fuel leakage.

In one embodiment, the screws 46 are already inserted in the through holes of the fuel injector cup 30 before the fuel injector 20 is shifted into the fuel injector cup 30. A non-threaded portion of the screws the plate element 38 may protrude beyond the through-holes and provide axial guidance for the plate element 38 during assembly. This embodiment is shown before the establishment of the thread connection of the screws 46 with the plate element 38 and the fuel injector cup 30 in FIG. 2.

For disassembling the fuel injector 20 from the fuel injector cup 30, the wing clip 48 is disassembled from the shoulder 47 of the fuel injector body 21. Then the screws 46 are removed and the fuel injector 20 can be shifted away from the fuel injector cup 30 in the axial direction, and the fuel injector cup 30 and the fuel injector 20 can be separated from each other. Alternatively, the screws 46 can be unscrewed before disassembling the wing clip 48 from the fuel injector 20.

The wing clip 48 between the plate element 38 and the shoulder 47 together with the snap ring 42 between the collar and the step 27 allows for assembling the fuel injector 20 and the fuel injector cup 30 in such a manner that a movement of the fuel injector 20 relative to the fuel injector cup 30 can be prevented in both directions D1, D2 of the central longitudinal axis L. During the process of mounting the plate element 38 and the snap ring 42, there is enough space to allow for a limited movement of the fuel injector 20 relative to the plate element 38 and the snap ring 42. The wing clip 48 may easily be mounted between the plate element 38 and the shoulder 47. During the mounting process, the wing clip 48 does not exert an additional force on the injector 20. As the wing clip 48 can be arranged outside the fuel injector cup 30, the wing clip 48 can be assembled and disassembled without disassembling the injector 20 from the fuel injector cup 30 and the fuel rail 18.

Figure 5:
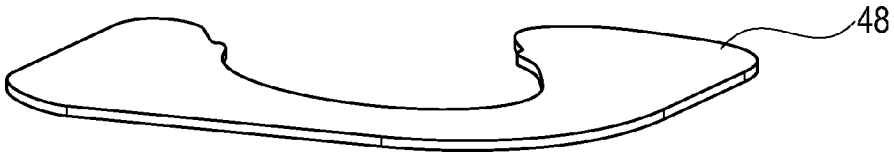
FIG. 5 shows a first example of a wing clip before screw assembly.
Figure 6:
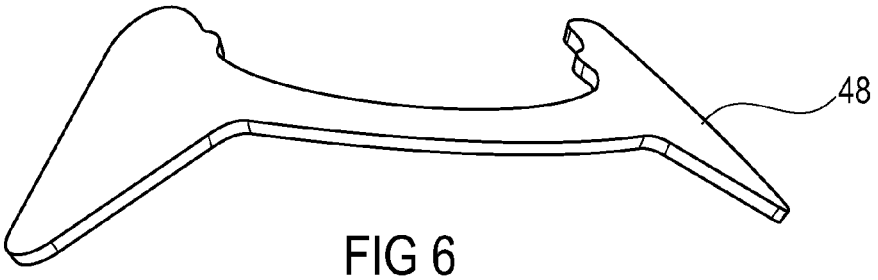
FIG. 6 shows the first example of the wing clip after final screw assembly.

FIG. 5 shows a first example of a wing clip 48 for the fuel injector assembly 60 of FIGS. 2 and 3 before screw assembly. FIG. 6 shows the first example of the wing clip 48 after final screw assembly.

Figure 4:
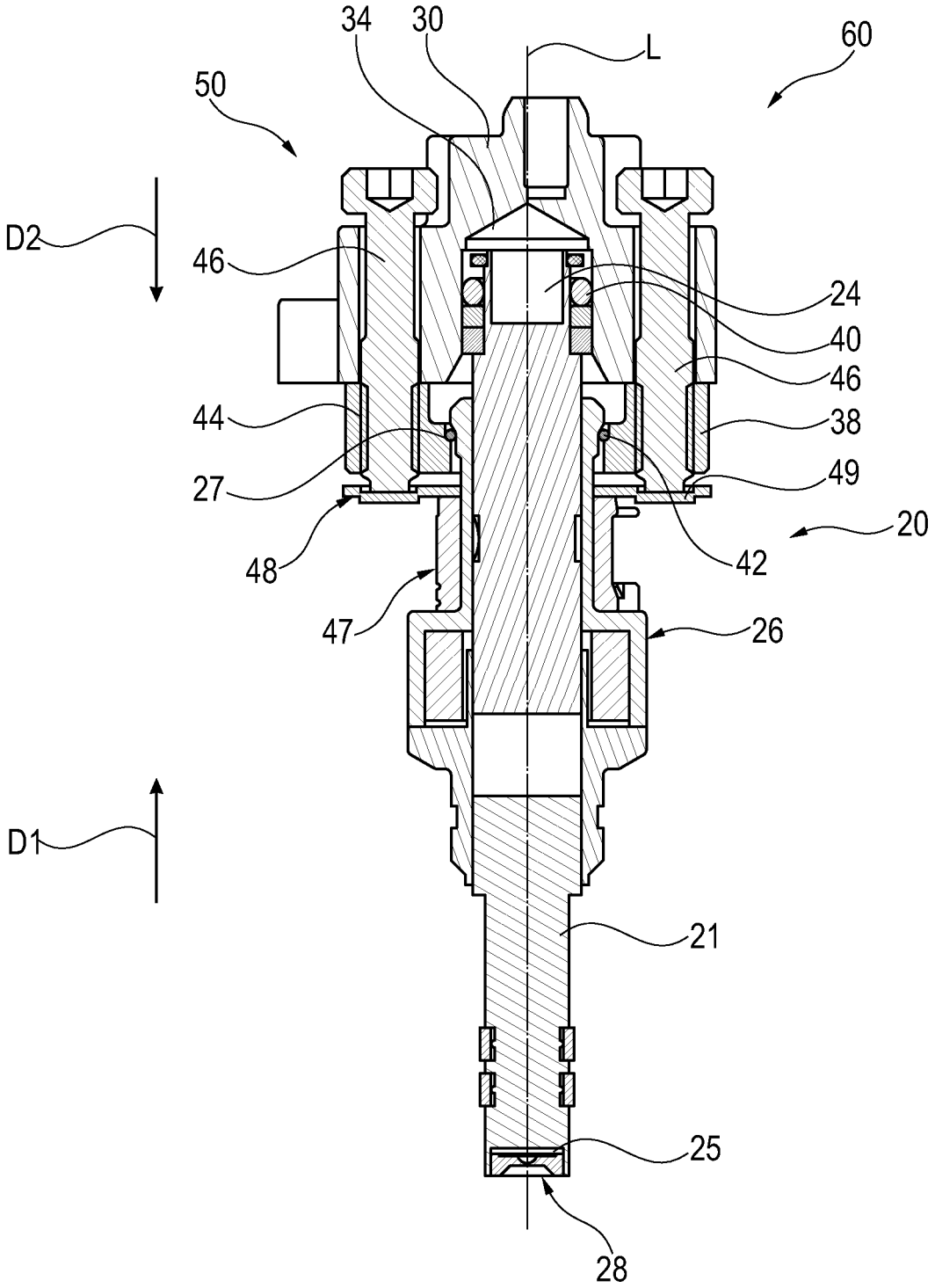
FIG. 4 shows a longitudinal section through a fuel injector assembly with a second example of a coupling device.

FIG. 4 shows the fuel injector assembly with a second example of a coupling device 60. The design of the coupling device 60 of the second example corresponds in general with that of the first example. However, in this embodiment the wing clip 48 comprises one or more recesses 49 for keeping the screw 46 or screws 46 in a given position.

Figure 7:
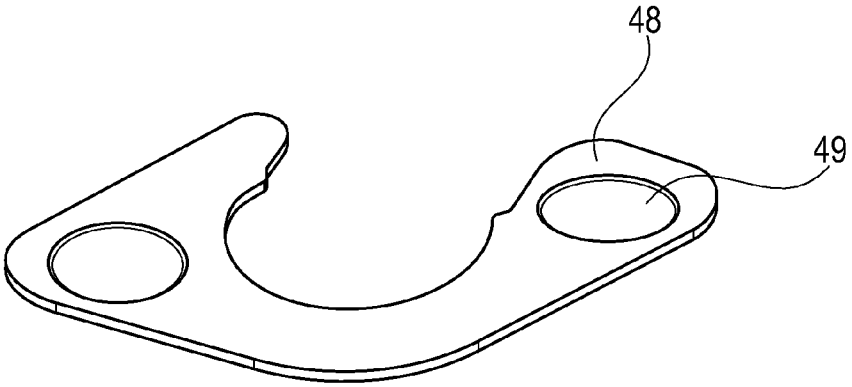
FIG. 7 shows a second example of the wing clip.

FIG. 7 shows the second example of the wing clip 48 used in the fuel injector assembly 60 of FIG. 4. The wing clip 48 comprises one or more recesses 49 for keeping the screw 46 or screws 46 in a given position.

In particular, the shape, the material and the thickness of the wing clip 48 may be selected according to a given dimension and tolerance requirements. Preferably, a stiffness of the wing clip 20 is selected such it allows to keep an injector tip in a correct position, satisfying in this way a given spray specification.

What is claimed is:

1. A fuel injector assembly comprising:

a fuel injector, and a coupling device for hydraulically and mechanically coupling the fuel injector to a fuel rail of a combustion engine, wherein the fuel injector has a central longitudinal axis and the coupling device comprises:

a fuel injector cup, a plate element, one or more screws, and a wing clip, wherein the fuel injector cup is configured to be hydraulically coupled to the fuel rail and configured to receive a fuel inlet portion of the fuel injector, wherein the plate element comprises a central opening through which the fuel injector extends and at least one through-hole for fixedly coupling the fuel injector cup with the plate element by the screw or screws respectively, such that the fuel injector cup, the plate element, and the screw(s) are positionally fixed with respect to each other, and wherein the wing clip is arranged at least partly around the fuel injector and extends outward in a radial direction such that the one or more screws bear on a surface of the wing clip without passing therethrough said surface and thereby block a movement of the fuel injector relative to the plate element in a first direction along the central longitudinal axis by a mechanical interaction with the wing clip but do not screw into the wing clip and thereby allow a movement of the fuel injector in a second direction opposed to the first direction along the central longitudinal axis.

2. The fuel assembly of claim 1, wherein the coupling device further comprises a snap ring configured to interact mechanically with the plate element and the fuel injector to retain the fuel injector in the fuel injector cup by blocking a movement of the fuel injector relative to the plate element in a second direction of the central longitudinal axis, which is opposite to the first direction of the central longitudinal axis.

3. The fuel assembly of claim 2, wherein the central opening of the plate element comprises a step, and wherein the snap ring bears on the step.

4. The fuel assembly of claim 1, wherein the fuel injector comprises a shoulder extending in a radial direction, and wherein the wing clip is arranged axially between the shoulder and the plate element such that the one or more screws are in contact with the wing clip to press the wing clip against the shoulder.

5. The fuel assembly of claim 1, wherein the wing clip has a spring characteristic.

6. The fuel assembly of claim 1, wherein the wing clip comprises a spring steel.

7. The fuel assembly of claim 1, wherein the wing clip comprises one or more recesses for keeping the one or more screws in a given position.

8. The fuel assembly of claim 1, wherein the one or more screws comprise a bolt length such that a given bending of the wing clip is reached.

9. A combustion engine for a vehicle, the combustion engine comprising:

a fuel rail; and a fuel injector assembly comprising:

a fuel injector, and a coupling device for hydraulically and mechanically coupling the fuel injector to the fuel rail, wherein the fuel injector has a central longitudinal axis and the coupling device comprises:

a fuel injector cup, a plate element, one or more screws, and a wing clip, wherein the fuel injector cup is configured to be hydraulically coupled to the fuel rail and configured to receive a fuel inlet portion of the fuel injector, wherein the plate element comprises a central opening through which the fuel injector extends and at least one through-hole for fixedly coupling the fuel injector cup with the plate element by the screw or screws respectively, such that the fuel injector cup, the plate element, and the screw(s) are positionally fixed with respect to each other, and wherein the wing clip is arranged at least partly around the fuel injector and extends outward in a radial direction such that the one or more screws bear on a surface of the wing clip without passing therethrough said surface and thereby block a movement of the fuel injector relative to the plate element in a first direction along the central longitudinal axis by a mechanical interaction with the wing clip but do not screw into the wing clip and thereby allow a movement of the fuel injector in a second direction opposed to the first direction along the central longitudinal axis.

10. The combustion engine of claim 9, wherein the coupling device further comprises a snap ring configured to interact mechanically with the plate element and the fuel injector to retain the fuel injector in the fuel injector cup by blocking a movement of the fuel injector relative to the plate element in a second direction of the central longitudinal axis, which is opposite to the first direction of the central longitudinal axis.

11. The combustion engine of claim 10, wherein the central opening of the plate element comprises a step, and wherein the snap ring bears on the step.

12. The combustion engine of claim 9, wherein the fuel injector comprises a shoulder extending in a radial direction, and wherein the wing clip is arranged axially between the shoulder and the plate element such that the one or more screws are in contact with the wing clip to press the wing clip against the shoulder.

13. The combustion engine of claim 9, wherein the wing clip has a spring characteristic.

14. The combustion engine of claim 9, wherein the wing clip comprises a spring steel.

15. The combustion engine of claim 9, wherein the wing clip comprises one or more recesses for keeping the one or more screws in a given position.

16. The combustion engine of claim 9, wherein the one or more screws comprise a bolt length such that a given bending of the wing clip is reached.

* * * * *